US008134530B2

(12) United States Patent
Takeda

(10) Patent No.: US 8,134,530 B2
(45) Date of Patent: Mar. 13, 2012

(54) LIQUID CRYSTAL DISPLAY DEVICE AND METHOD OF DRIVING THE SAME

(75) Inventor: Nobuhiro Takeda, Mobara (JP)

(73) Assignees: Hitachi Displays, Ltd., Chiba (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 644 days.

(21) Appl. No.: 12/333,360

(22) Filed: Dec. 12, 2008

(65) Prior Publication Data

US 2009/0153460 A1 Jun. 18, 2009

(30) Foreign Application Priority Data

Dec. 18, 2007 (JP) ..... 2007-325343

(51) Int. Cl.
*G09G 3/36* (2006.01)

(52) U.S. Cl. ..... 345/98; 345/87; 345/102

(58) Field of Classification Search ..... None
See application file for complete search history.

(56) References Cited

U.S. PATENT DOCUMENTS 6,937,224 B1 8/2005 Miyachi
7,522,134 B2 * 4/2009 Mizumaki ..... 345/87

FOREIGN PATENT DOCUMENTS

JP 2001-060078 3/2001

* cited by examiner

*Primary Examiner* — Muhammad N Edun
(74) *Attorney, Agent, or Firm* — Antonelli, Terry, Stout & Kraus, LLP.

(57) ABSTRACT

To change a proportion of a black image display period based on an image brightness in one frame, improving a moving image performance while suppressing a reduction in luminance. A method of driving a liquid crystal display device which includes a liquid crystal display panel having plural pixels, and displays a black image after displaying a video in each pixel, includes: when taking a period for which the video is displayed as a video display period, and a period for which the black image is displayed as a black image display period, based on an image brightness in one frame, changing a ratio of the black image display period to the video display period.

7 Claims, 6 Drawing Sheets

LIQUID CRYSTAL DISPLAY DEVICE AND METHOD OF DRIVING THE SAME

CROSS-REFERENCE TO RELATED APPLICATION

The present application claims priority from Japanese application JP2007-325343 filed on Dec. 18, 2007, the content of which is hereby incorporated by reference into this application.

BACKGROUND OF THE INVENTION

1. Technical Field

The present invention relates to a liquid crystal display device and a method of driving it, and in particular relates to a black insertion drive method for improving a moving image performance.

2. Related Art

In a case of classifying displays particularly from a viewpoint of a moving image displays, they are divided broadly into an impulse response type display and a hold response type display. The impulse response type display is a type in which, as in a decay characteristic of a cathode-ray tube, a luminance response is reduced immediately after a scanning, and the hold response type display is a type which, as in a liquid crystal display device, continues to maintain a luminance based on display data until a next scanning.

As a feature of the hold response type display, in a case of a still image, it is possible to acquire a good display quality having no flicker but, in a case of a moving image, there is a problem in that a so-called moving image blurring occurs in which a perimeter of a moving object looks blurry, reducing a display quality significantly.

A cause of the occurrence of the moving image blurring lies in a so-called retinal afterimage formed by an observer, when moving a line of sight along with a movement of an object, interpolating a display image before and after the movement with respect to a display image whose luminance is maintained, meaning that the moving image blurring is not completely eliminated no matter how greatly a response speed of the display is increased.

In order to solve this problem, a method is effective in which, in one frame, a regular video and a black image are displayed in a certain proportion (hereafter called a black insertion drive method) and, by once cancelling the retinal afterimage, the impulse response type display is approximated (refer to a patent document 1, to be mentioned below).

FIG. 8 is a diagram for illustrating an outline of one example of a heretofore known black insertion drive method.

The method shown in FIG. 8 is one arranged in such a way that, as shown in DSCN of FIG. 8, in one frame FLAM, from a top of a display panel downward, a video voltage is written sequentially into pixels on one display line, also, as shown in BSCN of FIG. 8, a black image voltage is written sequentially into pixels on one display line, and the writing of the video voltage shown in DSCN of FIG. 8 and the writing of the black image voltage shown in BSCN of FIG. 8 are alternately carried out.

That is, in FIG. 8, a step 1 of writing a black image voltage after a period TD (hereafter called a video display period) has elapsed after writing a video voltage into pixels, and a step 2 of writing a video voltage after a period TB (hereafter called a black image display period) has elapsed after writing the black image voltage, are repeated. In FIG. 8, PV indicates a display line position of a liquid crystal display panel, and T a time.

As a related art document relating to the invention, there is a patent document 1 JP-A-2001-60078.

SUMMARY OF THE INVENTION

In the black insertion drive method shown in FIG. 8, as opposed to the video display period TD during which a video is displayed, during the black image display period TB, a black image is displayed and, by converting the video into an impulse, a moving image performance is caused to be improved. In this case, in the black insertion drive method shown in FIG. 8, a ratio of the black image display period TB to the video display period TD has been constant (TD/TB=constant).

Meanwhile, in the black insertion drive method shown in FIG. 8, although it is known that the moving image performance is improved by increasing the black image display period TB, in the event that the black image display period TB is increased, as a transmission amount of light from a backlight is reduced, there has been a problem in that a contrast ratio is reduced. In order to solve the problem, it is necessary to increase a luminance of the backlight, but there is a problem in that a power consumption is consequently increased.

The invention having been contrived in order to solve the problems of the heretofore known technology heretofore described, an object of the invention is to provide a technology in which, in a liquid crystal display device and a method of driving it, a proportion of a black image display period being changed based on an image brightness in one frame, it is possible to improve a moving image performance while suppressing a reduction in luminance.

The heretofore described object, another object, and a novel feature, of the invention will be disclosed using the description of the present specification and the accompanying drawings.

To briefly describe a summary of a typical invention, among inventions disclosed in the present application, it is as follows.

1. A method of driving a liquid crystal display device which, including a liquid crystal display panel having a plurality of pixels, in each pixel, displays a black image after displaying a video, includes: when taking a period for which the video is displayed as a video display period, and a period for which the black image is displayed as a black image display period, based on a video brightness in one frame, changing a ratio of the black image display period to the video display period.

2. A liquid crystal display device includes: a liquid crystal display panel having a plurality of pixels, a plurality of video lines and a plurality of scan lines; a video line drive circuit which supplies each of the video lines with a video voltage and a black image voltage; a scan line drive circuit which supplies each of the scan lines with a video selection scan voltage for writing the video voltage and a black image selection scan voltage for writing the black image voltage; and a display control circuit which controls and drives the video line drive circuit and the scan line drive circuit. The scan line drive circuit, as well as supplying the scan lines, in order, with the video selection scan voltage, supplies the scan lines, in order, with the black image selection scan voltage for writing the black image voltage, and supplies the scan lines with the video selection scan voltage and the black image selection scan voltage alternately. The video line drive circuit supplies each of the video lines with the video voltage when the scan line drive circuit is supplying the scan lines with the video selection scan voltage, and supplies each of the video lines with the black image voltage when the scan line drive circuit is supplying the scan lines with the black image selections can voltage. The display control circuit has a black image insertion control circuit which, based on an image brightness in one frame, changes a position of a scan line to be supplied next with the black image selection scan voltage after the scan line has been supplied with the video selection scan voltage, changing an insertion ratio of the black image.

3. In 2, the black image insertion control circuit includes: a counting circuit which counts a quantity of data, among input display data in one frame input from an exterior, for each gradation; a gradation conversion factor calculation circuit which, based on a result of the counting in the counting circuit, calculates an accumulated data quantity from a minimum gradation to each gradation on a gradation by gradation basis, and outputs a gradation, in which the accumulated data quantity calculated is equal to or higher than a preset data enlargement threshold, as a gradation conversion factor; a display data conversion circuit which, based on the gradation conversion factor output from the gradation conversion factor calculation circuit, converts input display data of a gradation higher than a gradation conforming to the gradation conversion factor into output display data of a maximum gradation, also, based on a predetermined relational expression, converts input display data from a minimum gradation to the gradation conforming to the gradation conversion factor into the output display data from the minimum gradation to the maximum gradation, and outputs them to the video line drive circuit; and a scan control signal generation circuit which, based on the gradation conversion factor output from the gradation conversion factor calculation circuit, generates a control signal which selects a position of a scan line to be supplied next with the black image selection scan voltage after the scan line has been supplied with the video selection scan voltage, and outputs it to the scan line drive circuit.

4. In 3, when a gradation of the input display data is indicated by Kin, a gradation of the output display data by Kout, the gradation conversion factor by Kth, and the maximum gradation of the output display data by Kout-max, the display data conversion circuit converts the input display data into the output display data of gradations represented by the following equations.

$$Kout=(Kout\text{-}max/Kth)\times Kin \text{ (where } Kin\leqq Kth)$$

$$Kout=Kout\text{-}max \text{ (where } Kth<Kin)$$

5. In 3, the display data conversion circuit, referring to a look-up table, converts the input display data of the gradation higher than the gradation conforming to the gradation conversion factor into the output display data of the maximum gradation, and converts the input display data from the minimum gradation to the gradation conforming to the gradation conversion factor into the output display data from the minimum gradation to the maximum gradation.

6. In any one of 3 to 5, the scan control signal generation circuit obtains a luminance of the liquid crystal display panel at a time of the gradation conforming to the gradation conversion factor from a gradation-luminance characteristic of the liquid crystal display panel in a case in which no black image insertion is carried out, obtains a black insertion ratio corresponding to the obtained luminance from a black insertion ratio-maximum luminance characteristic of the liquid crystal display panel, and generates a control signal which selects a position of a next scan line to be supplied with the black image selection scan voltage after the scan line has been supplied with the video selection scan voltage.

To briefly describe an advantage obtained by a typical invention, among inventions disclosed in the present application, it is as follows.

According to the liquid crystal display device, and the method of driving it, of the invention, the proportion of the black image display period being changed based on the video brightness in one frame, it is possible to improve the moving image performance while suppressing the reduction in luminance.

DESCRIPTION OF THE PREFERRED EMBODIMENT(S)

Figure 1:
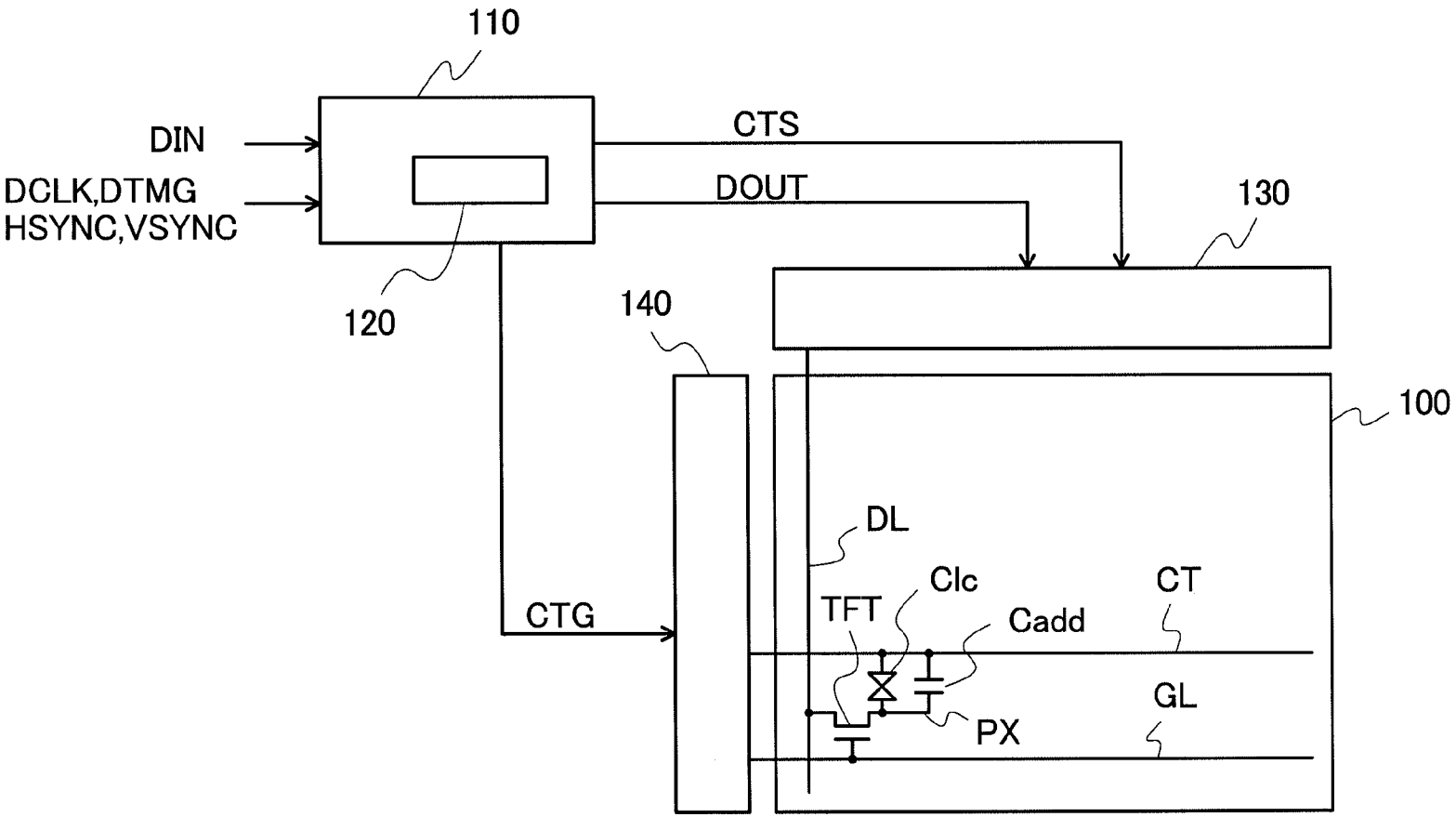
FIG. 1 is a circuit diagram showing an equivalent circuit of a liquid crystal display panel of a liquid crystal display device of an embodiment of the invention.

Hereafter, referring to the drawings, a detailed description will be given of an embodiment of the invention.

In all of the drawings for illustrating the embodiment, components having identical functions are indicated by identical reference numerals and characters, and a redundant description thereof will be omitted.

FIG. 1 is a circuit diagram showing an equivalent circuit of a liquid crystal display panel of a liquid crystal display device of the embodiment of the invention. As shown in FIG. 1, the liquid crystal display panel 100 of the embodiment has n scan lines (also called gate lines) GL and m video lines (also called source lines or drain lines) DL provided on one substrate (a first substrate) of a pair of substrates disposed facing each other across a liquid crystal.

An area surrounded by a scan line GL and a video line DL is a pixel area. An active element, for example, a thin film transistor TFT is formed in one pixel area. The thin film transistor TFT has a gate connected to the scan line, a drain (or a source) connected to the video line, and the source (or the drain) connected to a pixel electrode PX.

Also, a retention capacitor Cadd is provided between the pixel electrode PX and an opposite electrode (also called a common electrode) CT. As the liquid crystal is interposed between the pixel electrode and the opposite electrode CT, a liquid crystal capacitor Clc is also formed between the pixel electrode and the opposite electrode CT.

Each scan line GL is connected to a scan line drive circuit 140. The scan line drive circuit 140 supplies the scan lines GL, in order, with a video selection scan voltage for writing a video voltage into pixels on one display line in a horizontal direction. Also, the scan line drive circuit 140 supplies the scan lines GL, in order, with a black image selection scan voltage for writing a black image voltage into pixels on one display line. Furthermore, the scan line drive circuit 140 supplies the scan lines GL with the video selection scan voltage and the black image selection scan voltage alternately.

Each video line DL is connected to a video line drive circuit 130. The video line drive circuit 130, when the scan line drive circuit 140 is supplying the scan lines GL with the video selection scan voltage, supplies each video line DL with a video voltage. Also, the video line drive circuit 130, when the scan line drive circuit 140 is supplying the scan lines GL with the black image selection scan voltage, supplies each video line DL with a black image voltage.

A display control circuit 110 controls and drives the video line drive circuit 130 and the scan line drive circuit 140, based on input display data DIN input from a display signal source (a host side), such as a personal computer or a television receiving circuit, and on a display control signal (a dot clock DCLK, a display timing signal DTMG, a horizontal synchronization signal HSYNC, or a vertical synchronization signal VSYNC).

The liquid crystal display panel of the embodiment is formed by superimposing the first substrate (also called a TFT substrate or an active matrix substrate) (not shown), provided with a pixel electrode, a thin film transistor and the like, and a second substrate (also called an opposite substrate) (not shown), on which are formed a color filter and the like, with a predetermined space between them. A seal material, provided in a frame form in a perimeter vicinity of the first and second substrates, is applied between the first substrate and the second substrate, and the two substrates are bonded together. Also, the liquid crystal is inserted into an inside of the seal material between the two substrates from a liquid crystal fill port provided in one portion of the seal material, and subsequently, by sealing the liquid crystal fill port, a liquid crystal material is maintained between the two substrates. Furthermore, by affixing polarizing plates to outer sides of the two substrates, the liquid crystal display panel is configured.

Also, in a case of a TN type or VA type liquid crystal display panel, the opposite electrode is provided on the second substrate (the opposite substrate) side. In a case of an IPS type, it is provided on the first substrate (the TFT substrate) side. As the invention has no relation to an internal structure of a liquid crystal panel, a detailed description of the internal structure of the liquid crystal panel will be omitted. Also, the invention is applicable to any kind of structure of liquid crystal panel.

Furthermore, a backlight is also disposed on a rear surface side of the liquid crystal display panel but, as the invention has no relation to the backlight, a detailed description of the backlight will be omitted.

Figure 8:
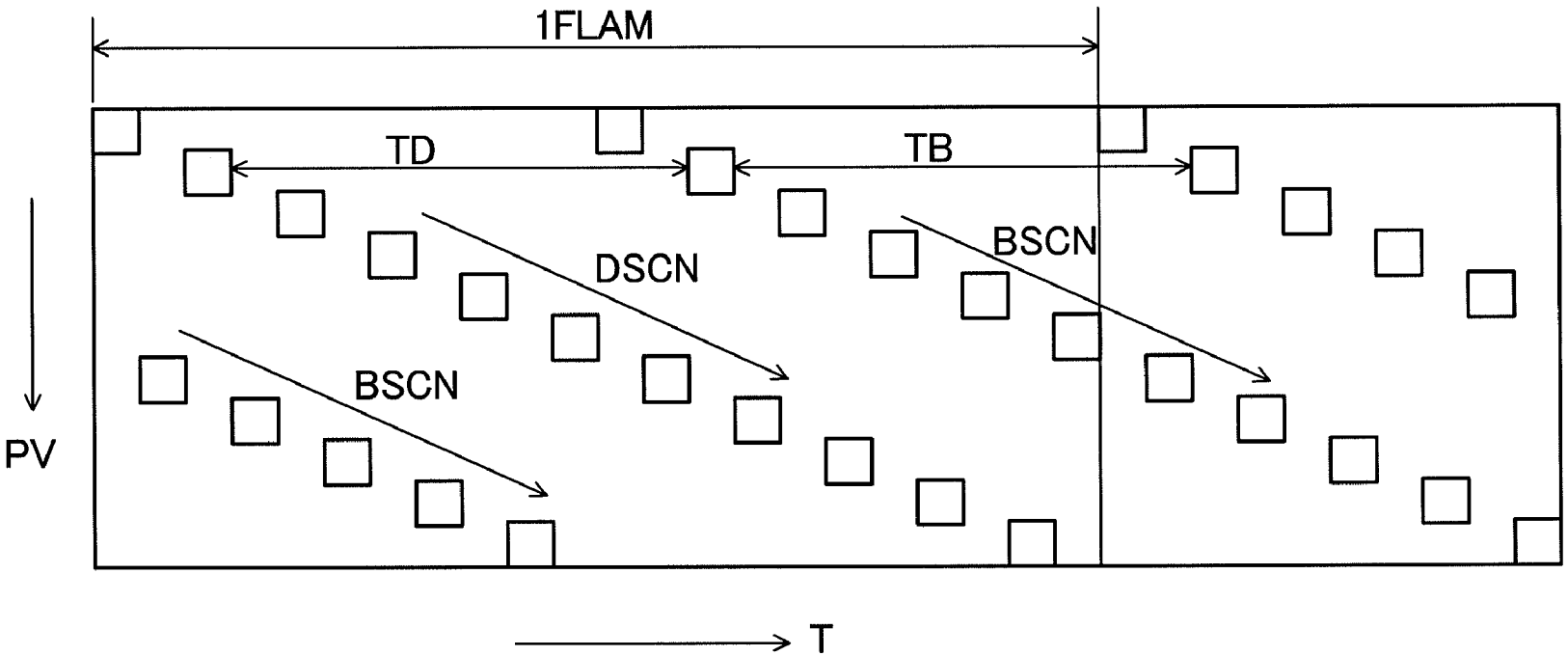
FIG. 8 is a diagram for illustrating an outline of one example of a heretofore known black insertion drive method.

The display control circuit 110 of the embodiment has an internal black image insertion control circuit 120. In the embodiment, a configuration is such as to, based on an image brightness in one frame, change a proportion of a black image display period (TB in FIG. 8) by means of the black image insertion control circuit 120, improving a moving image performance while suppressing a reduction in luminance.

Figure 2:
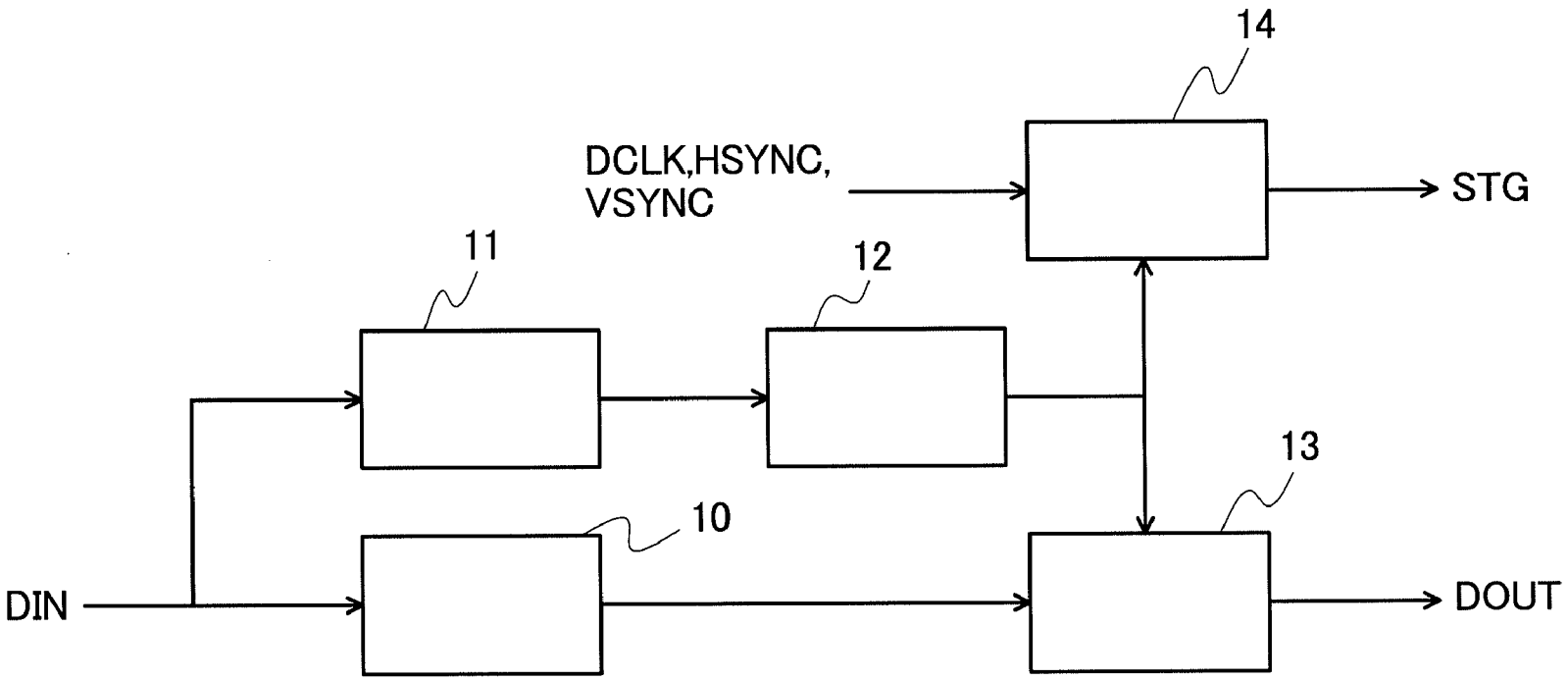
FIG. 2 is a block diagram showing an outline configuration of a black image insertion control circuit shown in FIG. 1.

FIG. 2 is a block diagram showing an outline configuration of the black image insertion control circuit 120 shown in FIG. 1.

As shown in FIG. 2, the black image insertion control circuit 120 has a frame memory 10, a counting circuit 11, a gradation conversion factor calculation circuit 12, a display data conversion circuit 13, and a scan control signal generation circuit 14.

The input display data DIN, as well as being input into the frame memory 10, are input into the counting circuit 11.

Figure 3:
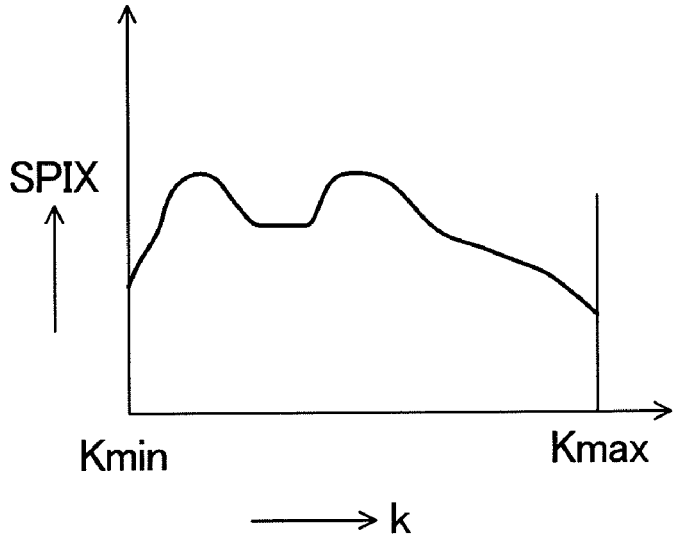
FIG. 3 is a graph showing one example of a result of a counting in a counting circuit shown in FIG. 2.

The counting circuit 11 counts a quantity of data SPIX, among input display data DIN in one frame, for each gradation k. One example of a result of the counting in the counting circuit 11 is shown in the graph of FIG. 3.

Figure 4:
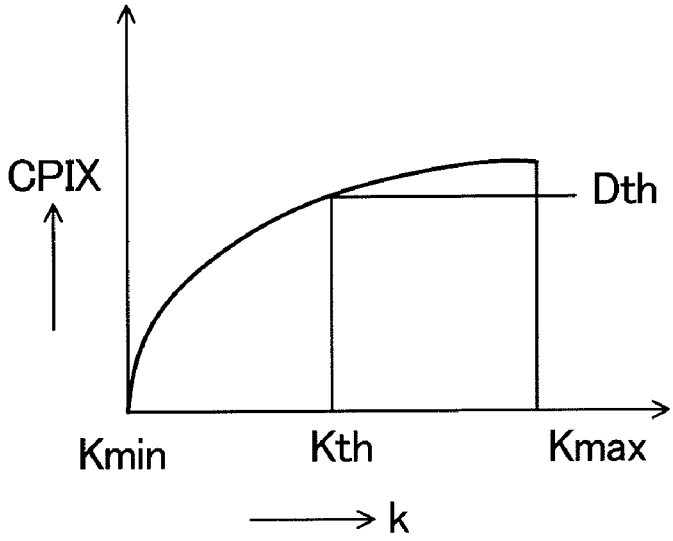
FIG. 4 is a graph for illustrating a method of calculating a gradation conversion factor in a gradation conversion factor calculation circuit shown in FIG. 2.

As shown in FIG. 4, the gradation conversion factor calculation circuit 12, based on the counting result in the counting circuit 11, calculates an accumulated data quantity CPIX from a minimum gradation Kmin to each gradation k on a gradation by gradation basis, and outputs a gradation, in which the accumulated data quantity calculated is equal to or higher than a preset data enlargement threshold Dth, as a gradation conversion factor Kth.

In the embodiment, a pixel quantity in which an image is saturated with respect to a total pixel quantity of the liquid crystal display panel is preset as the data enlargement threshold Dth but, as the data enlargement threshold Dth is in a trade-off relation between an image quality and the moving image performance, it is determined depending on an application or the like of the liquid crystal display panel.

The input display data DIN stored in the frame memory 10 are input into the display data conversion circuit 13.

The display data conversion circuit 13, based on the gradation conversion factor Kth output from the gradation conversion factor calculation circuit 12, converts input display data DIN of a gradation (k: $k>Kth$) higher than a gradation conforming to the gradation conversion factor Kth into output display data DOUT of a maximum gradation Kmax, and also, based on a predetermined relational expression, converts input display data DIN from the minimum gradation Kmin to a gradation (k: $Kmin \leqq k \leqq Kth$) conforming to the gradation conversion factor Kth into output display data DOUT from the minimum gradation Kmin to the maximum gradation Kmax, and outputs them to the video line drive circuit 130.

Herein, the predetermined relational expression is determined based on parameters, such as a gradation-luminance characteristic of the liquid crystal display panel, a response characteristic, and a vertical base line period, in such a way that a luminance is equal to that in a case in which no black image is displayed.

Figure 5:
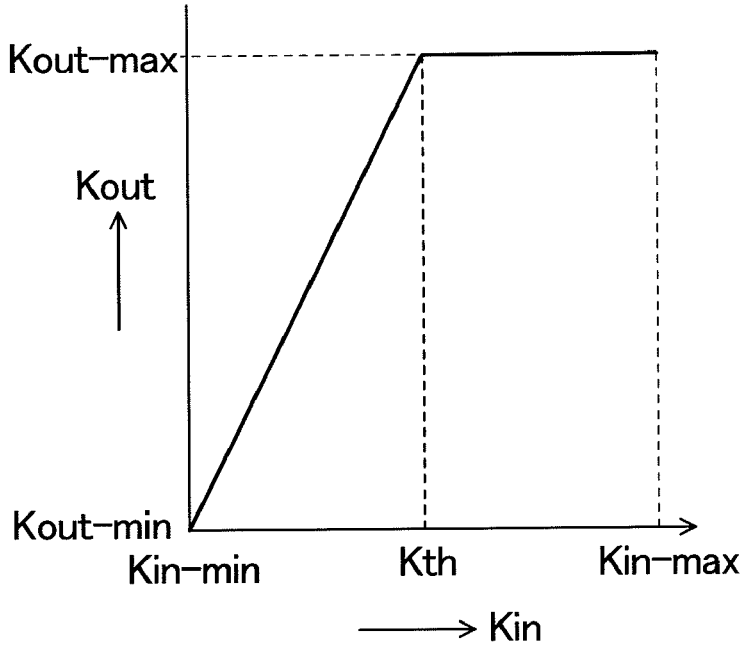
FIG. 5 is a graph showing one example of a display data conversion method of a display data conversion circuit shown in FIG. 2.

FIG. 5 shows one example of a display data conversion method of the display data conversion circuit 13. In FIG. 5, Kout indicates a gradation of output display data, and Kin indicates a gradation of input display data.

In the case of FIG. 5, when the gradation Kin of input display data DIN is higher than the gradation conforming to the gradation conversion factor Kth, the input display data DIN are converted into output display data DOUT of a maximum gradation Kout-max.

Also, input display data DIN from a minimum gradation Kin-min to the gradation conforming to the gradation conversion factor Kth are converted into output display data DOUT of a gradation obtained from a relational expression $Kout=(Kmax/Kth)\times Kin$. In a case in which a remainder is left in the previously mentioned relational expression, by ignoring a decimal place, or adding +1 to a quotient value, the gradation Kout of the output display data is set to be an integer.

In the previously described explanation, a description has been given of a method of converting display data by means of a calculation circuit, but it is acceptable to arrange in such a way as to convert display data using a look-up table.

Figure 6:
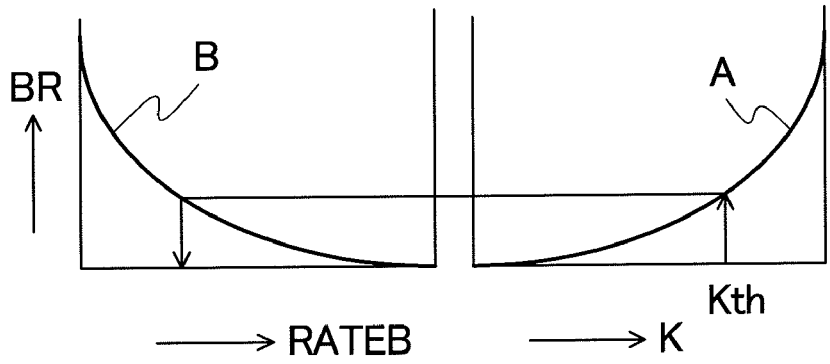
FIG. 6 is a graph for illustrating a method of calculating a black insertion ratio in the liquid crystal display device of the embodiment of the invention.

The scan control signal generation circuit 14, as shown in FIG. 6, obtains a luminance corresponding to the gradation conversion factor Kth from the gradation-luminance characteristic (A in FIG. 6) of the liquid crystal display panel in a case in which no black insertion is carried out, and obtains a black insertion ratio with respect to an image in one frame, that is, a black image display period TB with respect to a video display period TD, from a maximum display luminance-black insertion ratio characteristic (B in FIG. 6) of the liquid crystal display panel.

The scan control signal generation circuit 14, based on the black insertion ratio obtained, determines a position (generally, a top, or a position of a bottom gate line) of a scan line GL at a starting time, in which a video voltage is written into pixels on one display line, and then a position of a gate line GL at a starting time, in which a black image voltage is written into pixels on one display line, and outputs them as control signals to the scan line drive circuit 140.

Figure 7:
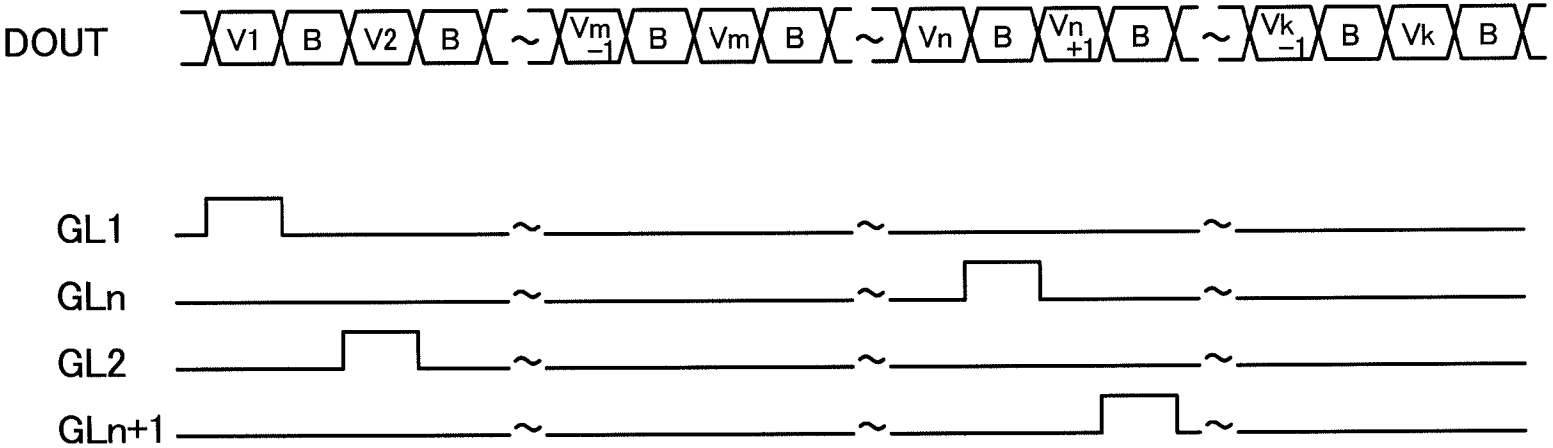
FIG. 7 is a diagram for illustrating operations of a video line drive circuit and scan line drive circuit shown in FIG. 1.

Hereafter, using FIG. 7, a brief description will be given of operations of the video line drive circuit 130 and scan line drive circuit 140 of the embodiment.

The video line drive circuit 130 repeatedly outputs video voltages (V1 to Vk) and black display signals B. The scan line drive circuit 140, in accordance with the video voltage V1 of a 1st display line, outputs the video selection scan voltage to a scan line GL1 of the 1st display line. Next, the scan line drive circuit 140 starts a scanning with a black image selection scan voltage on an nth display line determined based on the black insertion ratio and, by repeating the same on a 2nd display line, an (N+1)th display line, and a 3rd display line, in this order, carries out a scanning of an image display and a black display.

As heretofore described, according to the embodiment, an accumulated data quantity CPIX from the minimum gradation Kmin of input display data DIN in one frame to each gradation k is calculated for each gradation, and the gradation in which the accumulated data quantity calculated is equal to or higher than the preset data enlargement threshold Dth is output as a gradation conversion factor Kth. Next, input display data DIN are converted in such a way that a gradation conforming to the gradation conversion factor Kth is the maximum gradation Kmax, generating the output display data DOUT. Also, the black image display period (TB in FIG. 8) is dynamically changed based on the gradation conversion factor Kth.

Herein, in a case in which the gradation conforming to the gradation conversion factor Kth is on a low gradation side, the black image display period is increased.

In this way, in the embodiment, as it is possible to dynamically change the ratio of the black image display period (TB in FIG. 8) to the video display period (TD in FIG. 8), it is possible to improve the moving image performance while suppressing the reduction in luminance.

Also, in the embodiment, as it is possible to increase a black insertion amount using the gradation of the input display data DIN, it being possible to improve the moving image performance in an image having many halftone displays in which a liquid crystal response speed is low, it is possible to realize the same kind of advantageous effect as that of an overdrive circuit.

Furthermore, in the embodiment, as the black insertion ratio is reduced in an image having many bright pixels, there being a small reduction in luminance, it is possible to reduce a power consumption in comparison with the heretofore known black insertion drive method. Also, as it is possible to increase the black insertion ratio in an image having many dark pixels, it is possible to improve the moving image performance in comparison with the heretofore described black insertion drive method.

Although a specific description has heretofore been given, based on the heretofore described embodiment, of the invention contrived by the present inventor, the invention not being limited to the heretofore described embodiment, it is needless to say that it can be variously modified without departing from its scope.

What is claimed is:

1. A liquid crystal display device comprising:

a liquid crystal display panel having a plurality of pixels, a plurality of video lines and a plurality of scan lines;

a video line drive circuit which supplies each of the video lines with a video voltage and a black image voltage;

a scan line drive circuit which supplies each of the scan lines with a video selection scan voltage for writing the video voltage and a black image selection scan voltage for writing the black image voltage; and a display control circuit which controls the video line drive circuit and the scan line drive circuit, wherein the scan line drive circuit, as well as supplying the scan lines, in order, with the video selection scan voltage, supplies the scan lines, in order, with the black image selection scan voltage for writing the black image voltage, and supplies the scan lines with the video selection scan voltage and the black image selection scan voltage alternately, the video line drive circuit supplies each of the video lines with the video voltage when the scan line drive circuit is supplying the scan lines with the video selection scan voltage, and supplies each of the video lines with the black image Voltage when the scan line drive circuit is supplying the scan lines with the black image selection scan voltage, and the display control circuit has a black image insertion control circuit which, based on a video brightness obtained with the video voltage in one frame, changes a position of a scan line to be supplied next with the black image selection scan voltage after a scan line has been supplied with the video selection scan voltage, changing an insertion ratio of the black image.

2. The liquid crystal display device according to claim 1, wherein the black image insertion control circuit comprises:

a counting circuit which counts a quantity of data, among input display data in one frame, for each gradation;

a gradation conversion factor calculation circuit which, based on a result of the counting in the counting circuit, calculates an accumulated data quantity from a minimum gradation to each gradation on a gradation by gradation basis, and outputs a gradation, in which the accumulated data quantity calculated is equal to or higher than a preset data enlargement threshold, as a gradation conversion factor;

a display data conversion circuit which, based on the gradation conversion factor output from the gradation conversion factor calculation circuit, converts input display data of a gradation higher than a gradation conforming to the gradation conversion factor into output display data of a maximum gradation, and also, based on a predetermined relational expression, converts input display data from a minimum gradation to the gradation conforming to the gradation conversion factor into the output display data from the minimum gradation to the maximum gradation, and outputs them to the video line drive circuit; and a scan control signal generation circuit which, based on the gradation conversion factor output from the gradation conversion factor calculation circuit, generates a control signal which selects a position of a scan line to be supplied next with the black image selection scan voltage after the scan line has been supplied with the video selection scan voltage, and outputs it to the scan line drive circuit.

3. The liquid crystal display device according to claim 2, wherein when a gradation of the input display data is denoted by Kin, a gradation of the output display data by Kout, the gradation conversion factor by Kth, and the maximum gradation of the output display data by Kout-max, the display data conversion circuit converts the input display data into the output display data of gradations represented by the following equations $$Kout=(Kout\text{-}max/Kth)\times Kin \text{ (where } Kin \leqq Kth)$$

$$Kout=Kout\text{-}max \text{ (where } Kth < Kin).$$

4. The liquid crystal display device according to claim 3, wherein the scan control signal generation circuit obtains a luminance of the liquid crystal display panel at a time of the gradation conforming to the gradation conversion factor from a gradation-luminance characteristic of the liquid crystal display panel in a case in which no black image insertion is carried out, obtains a black insertion ratio corresponding to the obtained luminance from a black insertion ratio-maximum luminance characteristic of the liquid crystal display panel, and generates a control signal which selects a position of a next scan line to be supplied with the black image selection scan voltage after the scan line has been supplied with the video selection scan voltage.

5. The liquid crystal display device according to claim 2, wherein the display data conversion circuit, referring to a look-up table, converts the input display data of the gradation higher than the gradation conforming to the gradation conversion factor into the output display data of the maximum gradation, and converts the input display data from the minimum gradation to the gradation conforming to the gradation conversion factor into the output display data from the minimum gradation to the maximum gradation.

6. The liquid crystal display device according to claim 5, wherein the scan control signal generation circuit obtains a luminance of the liquid crystal display panel at a time of the gradation conforming to the gradation conversion factor from a gradation-luminance characteristic of the liquid crystal display panel in a case in which no black image insertion is carried out, obtains a black insertion ratio corresponding to the obtained luminance from a black insertion ratio-maximum luminance characteristic of the liquid crystal display panel, and generates a control signal which selects a position of a next scan line to be supplied with the black image selection scan voltage after the scan line has been supplied with the video selection scan voltage.

7. The liquid crystal display device according to claim 2, wherein the scan control signal generation circuit obtains a luminance of the liquid crystal display panel at a time of the gradation conforming to the gradation conversion factor from a gradation-luminance characteristic of the liquid crystal display panel in a case in which no black image insertion is carried out, obtains a black insertion ratio corresponding to the obtained luminance from a black insertion ratio-maximum luminance characteristic of the liquid crystal display panel, and generates a control signal which selects a position of a next scan line to be supplied with the black image selection scan voltage after the scan line has been supplied with the video selection scan voltage.

* * * * *